US011889872B2

(12) United States Patent
Iwai et al.

(10) Patent No.: US 11,889,872 B2
(45) Date of Patent: Feb. 6, 2024

(54) FIXING STRUCTURE FOR BRASSIERE SIDE BELT CATCHES

(71) Applicant: UTAX CO., LTD., Hyogo (JP)

(72) Inventors: Toshihide Iwai, Hyogo (JP); Tomoko Suehiro, Hyogo (JP); Yukihiro Miyake, Hyogo (JP); Daisuke Utaka, Hyogo (JP)

(73) Assignee: UTAX CO., LTD., Hyogo (JP)

( * ) Notice: Subject to any disclaimer, the term of this patent is extended or adjusted under 35 U.S.C. 154(b) by 654 days.

(21) Appl. No.: 17/053,939

(22) PCT Filed: Nov. 14, 2018

(86) PCT No.: PCT/JP2018/042180
§ 371 (c)(1),
(2) Date: Nov. 9, 2020

(87) PCT Pub. No.: WO2020/100240
PCT Pub. Date: May 22, 2020

(65) Prior Publication Data

US 2021/0219631 A1 Jul. 22, 2021

(51) Int. Cl.
*A41C 3/12* (2006.01)
*A44B 13/00* (2006.01)

(52) U.S. Cl.
CPC ..... *A41C 3/12* (2013.01); *A44B 13/0029* (2013.01)

(58) Field of Classification Search
CPC ..... A41C 3/12
(Continued)

(56) References Cited

U.S. PATENT DOCUMENTS 7,128,635 B1 * 10/2006 Liu ..... A41C 5/005 450/94
9,149,080 B2 10/2015 Zhang
(Continued)

FOREIGN PATENT DOCUMENTS

JP 3105465 10/2004
JP 3109786 6/2005
(Continued)

OTHER PUBLICATIONS

International Preliminary Report on Patentability dated May 18, 2021 in International (PCT) Patent Application No. PCT/JP2018/042180.
(Continued)

*Primary Examiner* — Timothy K Trieu
(74) *Attorney, Agent, or Firm* — Wenderoth, Lind & Ponack, L.L.P.

(57) ABSTRACT

To provide a fixing structure for side belt fasteners in which positions of fasteners at end portions of side belts are easy to find by touch, so that operations of attaching and detaching the fasteners are facilitated. In a fixing structure for side belt fasteners, side belt fasteners (eye tape 4 and hook tape 5) of a brassiere with a hook fitting and an eye fitting sewn on tape-shaped interlinings are attached between a front fabric 10*a* and a back fabric 10*b* of the brassiere 10 via adhesive layers. Outer edges of the interlinings 4*a* and 5*a* are set back inward with a predetermined length from outer edges of the front fabric 10*a* and the back fabric 10*b*, and the back fabric 10*b* covering the interlinings 4*a* and 5*a* is limited to one end portions of the interlinings 4*a* and 5*a*.

8 Claims, 5 Drawing Sheets

(58) Field of Classification Search
USPC ..... 450/82
See application file for complete search history.

(56) References Cited

U.S. PATENT DOCUMENTS

| | | | | |
|---|---|---|---|---|
| 2008/0045122 | A1* | 2/2008 | Utaka | A44B 13/00 450/25 |
| 2009/0300824 | A1 | 12/2009 | Yeung | |
| 2011/0283489 | A1* | 11/2011 | Yeung | A41F 1/006 24/442 |
| 2013/0068147 | A1* | 3/2013 | Cheung | A41F 1/006 112/475.08 |
| 2015/0004876 | A1 | 1/2015 | Zhang | |
| 2018/0303171 | A1 | 10/2018 | Lee | |
| 2022/0110420 | A1* | 4/2022 | Bonnefoy | A44B 13/00 |

FOREIGN PATENT DOCUMENTS

| | | |
|---|---|---|
| JP | 2006-200084 | 8/2006 |
| KR | 10-2011-0062298 | 6/2011 |
| WO | 2007/051244 | 5/2007 |

OTHER PUBLICATIONS

International Search Report dated Feb. 12, 2019 in International (PCT) Application No. PCT/JP2018/042180 with English translation.
Extended European Search Report dated Dec. 22, 2021 in corresponding European Patent Application No. 18940273.8.

* cited by examiner

FIXING STRUCTURE FOR BRASSIERE SIDE BELT CATCHES

TECHNICAL FIELD

The present invention relates to a fixing structure for fasteners such as hook fittings and eye fittings used for connecting side belts of a brassiere.

BACKGROUND ART

Fasteners such as hook fittings and eye fittings are attached to end portions of side belts of a brassiere by sewing or adhesion. Meanwhile, as for recent brassieres, non-sewn type brassieres that are hardly rugged, fit well to the skin, and have a good fit tend to be preferred (for example, non-sewn brassiere of JP 3792204 B2).

For this reason, the fasteners such as hook fittings and eye fittings are also required to have a good fit without steps of seams. Therefore, as in Patent Literature 1 (JP 2006-200084 A), a brassiere has been proposed in which fasteners such as hook tapes and eye tapes are attached to end portions of side belts by adhesion instead of sewing, and such a brassiere has already been put into practical use.

CITATIONS LIST

Patent Literature

Patent Literature 1: JP 2006-200084 A

SUMMARY OF INVENTION

Technical Problems

Since a wearer performs operations of attaching and detaching fasteners at end portions of side belts with both hands on the back side, the operations are not always easy if movable ranges of arms are small, although there are individual differences. In addition, there is a problem that, since the operations rely only on the feeling of fingers, if a surface is smooth as in a non-sewn brassiere, positions of the fasteners are difficult to find, hands may slip, and it may take time to perform the operations of attaching and detaching the fasteners.

Therefore, an object of the present invention is to provide a fixing structure for side belt fasteners in which positions of fasteners at end portions of side belts are easy to find by touch, so that attachment and detachment operations are facilitated.

Solutions to Problems

In order to solve the above problems, a fixing structure for side belt fasteners of the present invention is a fixing structure for side belt fasteners wherein side belt fasteners of a brassiere with a hook fitting and an eye fitting sewn on tape-shaped interlinings are attached between a front fabric and a back fabric of the brassiere via adhesive layers, outer edges of the interlinings are set back inward with a predetermined length from outer edges of the front fabric and the back fabric, and the back fabric covering the interlinings is limited to one end portion sides of the interlinings.

Advantageous Effects of Invention

In the fixing structure for side belt fasteners of the present invention, the outer edges of the interlinings of the fasteners are set back inward with a predetermined length from the outer edges of the front fabric and the back fabric, and the back fabric covering the interlinings is limited to one end portions of the interlinings, and thus positions of the fasteners are easy to find by touch, and operations of attaching and detaching the fasteners can be facilitated.

BRIEF DESCRIPTION OF DRAWINGS

FIG. 2Ab illustrates the front fabric side before the eye tape is arranged, seen from the front fabric side of the end portion of the side belt.

FIG. 2Ac illustrates the eye tape seen from a back fabric side of the end portion of the side belt.

FIG. 2Bb illustrates the hook tape of the end portion of the side belt seen from the front fabric side.

DESCRIPTION OF EMBODIMENT (Overall Configuration of Brassiere)

Figure 1A:
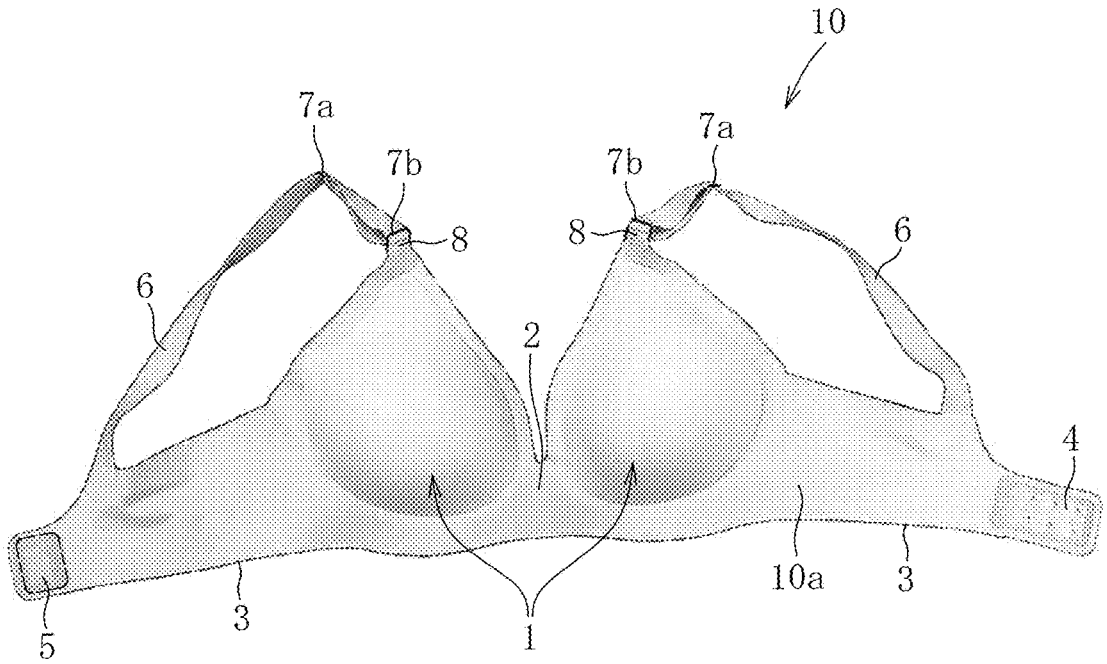
FIG. 1A is a front view of a brassiere having a fixing structure for fasteners according to an embodiment of the present invention.
Figure 1B:
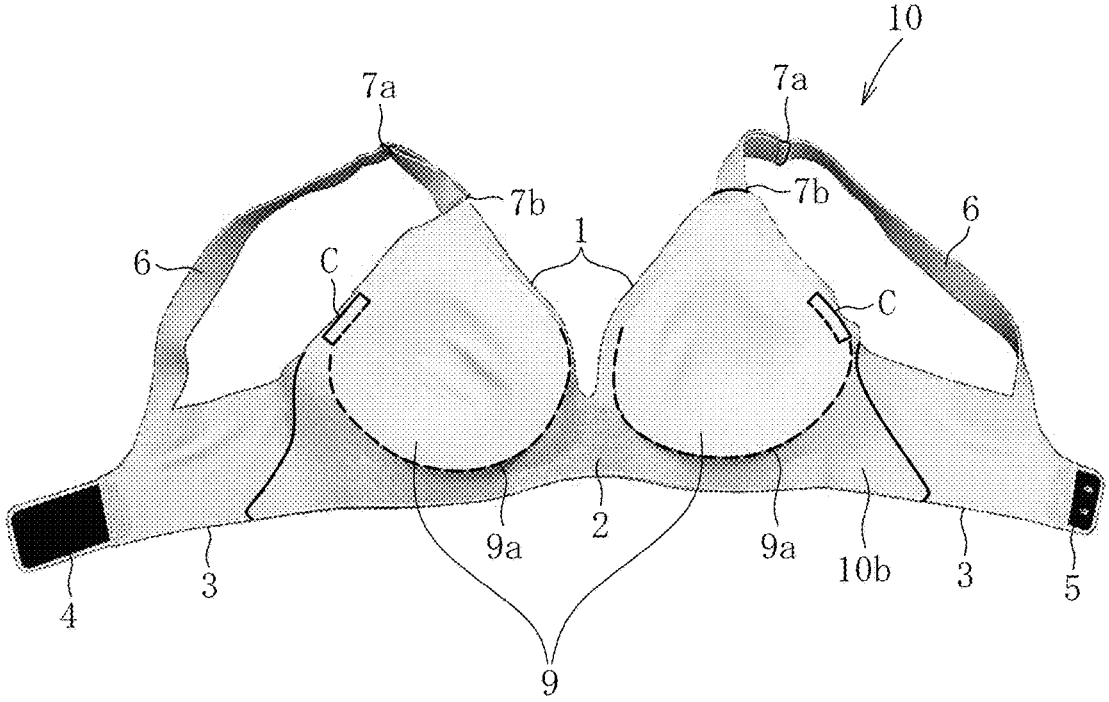
FIG. 1B is a back view of the brassiere.

A fixing structure for fasteners and a brassiere 10 having the fixing structure according to an embodiment of the present invention will be described below with reference to the drawings. FIGS. 1A and 1B are a front view and a back view of the brassiere 10.

A pair of right and left cup portions 1 of the brassiere 10 are connected to each other by a connecting portion 2 at the center of the brassiere 10. In the illustrated example, the cup portions 1 are illustrated as full cups, but the cup portions 1 may each have the size that covers at least half or more of a bust from a bottom of the bust, and may also be half cups or two-thirds cups.

Sides of the cup portions 1 opposite to the connecting portion 2 are connected to side belts 3. An eye tape 4 is attached to an end portion of one side belt 3, and a hook tape 5 is attached to an end portion of the other side belt 3.

The eye tape 4 and the hook tape 5 are connected on a back side when the brassiere 10 is worn. Instead of the eye tape 4 and the hook tape 5, for example, snaps, hook-and-loop fasteners, strings, buttons and button holes, or the like can also be used.

Both ends of straps 6 to be hung on shoulders are connected to upper edges near the end portions of the side belts 3 and upper edges of the cup portions 1. Moving rings 7*a* and fixed rings 7*b* are attached to end portions of the straps 6 on sides of the cup portions 1 so that the length of the straps 6 can be adjusted.

The fixed rings 7*b* are attached to the upper edges of the cup portions 1 by loop-shaped strap tabs 8. To form each of these strap tabs 8, a strip-shaped fabric is folded in half so as to wrap and hold a horizontal bar of the fixed ring 7*b* and is formed in a loop shape, and base end portions of the two layers are welded with resin dots between a front fabric 10*a* and a back fabric 10*b*.

The front fabric 10*a* and the back fabric 10*b*, which have elasticity and have almost the same shape, are attached to each other to be integrated by welding with the resin dots between the both fabrics, so that the brassiere 10 is formed. A type of fabric is not particularly limited, but for example, a two-way tricot fabric having elasticity in both vertical and horizontal directions can be used.

Adhesion positions of the resin dots may be random or may be regularly arranged vertically and horizontally in a matrix form. As materials of the resin dots, for example, polyurethane hot melt resin, polyester hot melt resin, EVA hot melt resin, polyolefin hot melt resin, styrene elastomer, moisture curable urethane hot melt resin, and reaction hot melt resin can be used.

The diameter of each of the resin dots can be, for example, about 0.5 mm. The adhesion density of the resin dots can be, for example, 5 to 20 dots/10 cm, and an occupied area ratio of the resin dots to the fabric can be, for example, 30%.

The cup portions 1 are each shaped into a bowl shape by molding, and pad pockets 9 are formed inside the cup portions 1 by the back fabric 10*b*. Each of the pad pockets 9 is for accommodating a bowl-shaped pad inside through a pad insertion port C, and has a substantially flat bag shape as a whole.

(Eye Tape and Hook Tape)

Figure 2A:
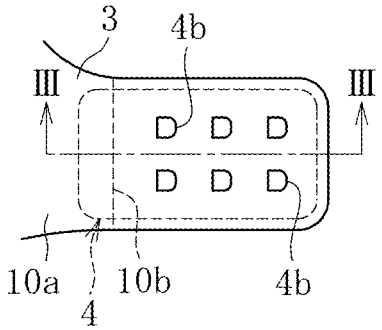
FIG. 2Aa illustrates an eye tape seen from a front fabric side of an end portion of a side belt.
Figure 2A:
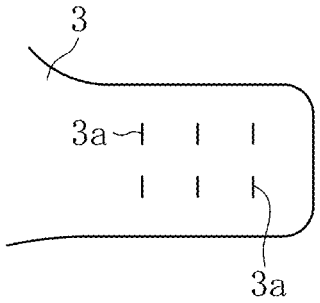
Figure 2A:
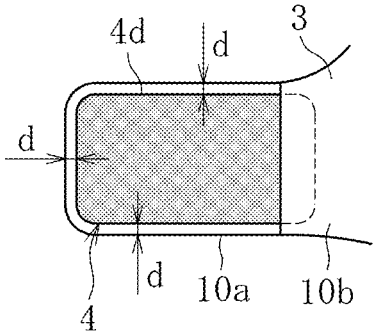

Next, details of the eye tape 4 and the hook tape 5 will be further described with reference to FIG. 2Aa to 4B. The eye tape 4 attached to the end portion of one side belt 3 includes an interlining 4*a* and eye fittings 4*b* sewn on the interlining 4*a*, as illustrated in FIGS. 2Aa to 2Ac and 3A.

The interlining 4*a* uses a fabric with low elongation. Cover cloths 4*d* are attached to both upper and lower sides of the interlining 4*a* via adhesive layers to hide seams.

Figure 4A:
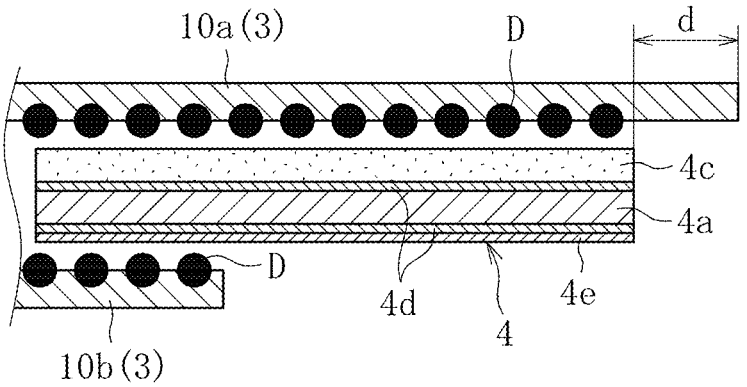
FIG. 4A is a cross-sectional view taken along the line III-III when a raised fabric is attached to a back surface of FIG. 2Aa.

As illustrated in FIG. 4A, a raised fabric 4*e* may be further attached to the cover cloth 4*d* on the lower side in order to soften the contact with the skin. In the illustrated example, the eye fittings 4*b* are arranged in two rows and three stages so that the length of the side belts 3 can be adjusted, but it goes without saying that each of the number of rows and the number of stages is any number.

Figure 3A:
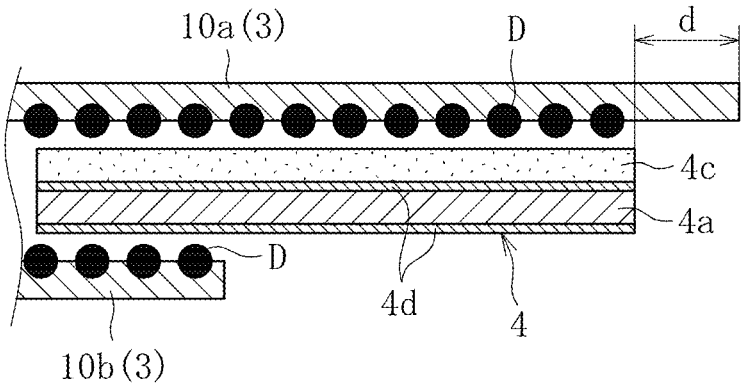
FIG. 3A is a cross-sectional view taken along a line III-III of FIG. 2Aa.

As illustrated in FIGS. 3A and 4A, a urethane elastomer film 4*c* is adhered to a surface of the eye tape 4 on a side where the eye tape 4 is attached to the front fabric 10*a*. Furthermore, heads of the eye fittings 4*b* are exposed from slits 3*a* formed in the front fabric 10*a* as illustrated in FIG. 2Aa, and then the eye tape 4 is heat-pressed to be welded to a back surface of the front fabric 10*a* by resin dots D and the urethane elastomer film 4*c*.

After this welding, one end portion of the eye tape 4 is covered with the back fabric 10*b* as illustrated in FIG. 2Ac and is welded to the back fabric 10*b*. In most of conventional eye tapes, the entire back surface is covered with the back fabric 10*b*, but in the present invention, most of the back surface is exposed except for one end portion side of the eye tape 4. Similarly, most of a surface of the hook tape 5, which will be described later, is exposed except for one end portion side.

The reason why most of the tapes 4 and 5 are exposed without being covered with the back fabric 10*b* in this way is as follows. That is, since a wearer uses both hands on the back side to attach and detach the eye tape 4 and the hook tape 5, attachment and detachment are not always easy if movable ranges of arms are small, although there are individual differences.

Furthermore, if the tapes 4 and 5 are completely covered with the back fabric 10*b* as in a conventional case, positions of the tapes 4 and 5 are more difficult to find in a case of a non-sewn brassiere with a smooth surface because attachment and detachment operations rely only on the feeling of fingers. For this reason, and partly because tape parts are slippery, it takes time to perform the operations of attaching and detaching the tapes 4 and 5 in some cases.

Therefore, the present invention positively exposes most of the tapes 4 and 5, so that the positions of the tapes 4 and 5 can be clearly found by a touch with the fingers. However, since the back surface of the eye tape 4 comes into direct contact with the skin, in order to soften the contact of the eye fittings 4*b* with the skin, it is desirable to attach the raised fabric 4*e* to an exposed surface of the eye tape 4, as illustrated in FIG. 4A, to suppress the irritation to the skin, in addition to covering the end portion of the eye tape 4 on a side of the cup portion 1 with the back fabric 10*b*. Since the back fabric 10*b* is elastic and thin (about 500 μm), there is almost no step at a part covering the end portion of the eye tape 4, and a good texture is maintained.

Figure 2B:
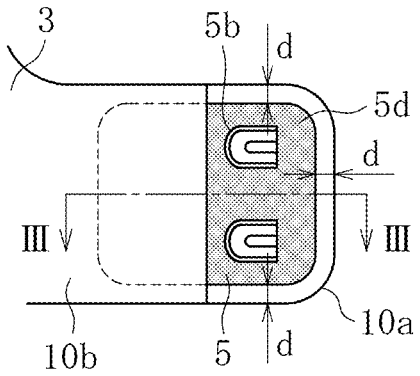
FIG. 2Ba illustrates a hook tape of an end portion of a side belt seen from the back fabric side.
Figure 2B:
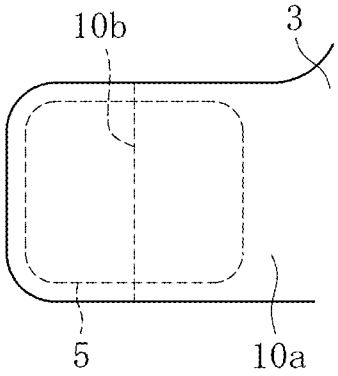

The hook tape 5 attached to the end portion of the other side belt 3 includes an interlining 5*a* and a pair of hook fittings 5*b* sewn on the interlining 5*a*, as illustrated in FIGS. 2Ba, 2Bb, and 3B. The interlining 5*a* also uses a fabric with low elongation. Cover cloths 5*d* are attached to both upper and lower sides of the interlining 5*a* via adhesive layers to hide seams.

Figure 3B:
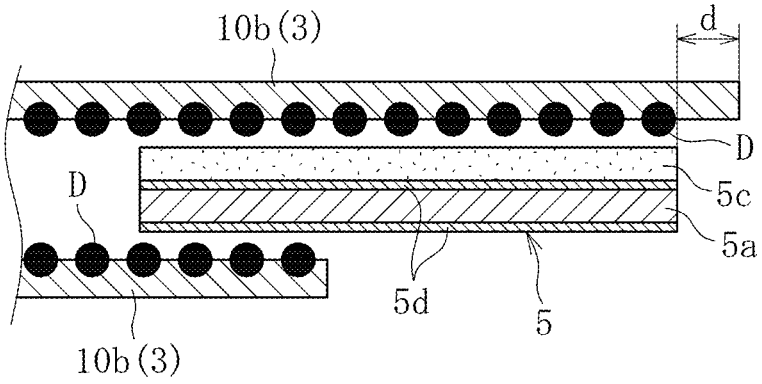
FIG. 3B is a cross-sectional view taken along a line III-III of FIG. 2Ba.
Figure 4B:
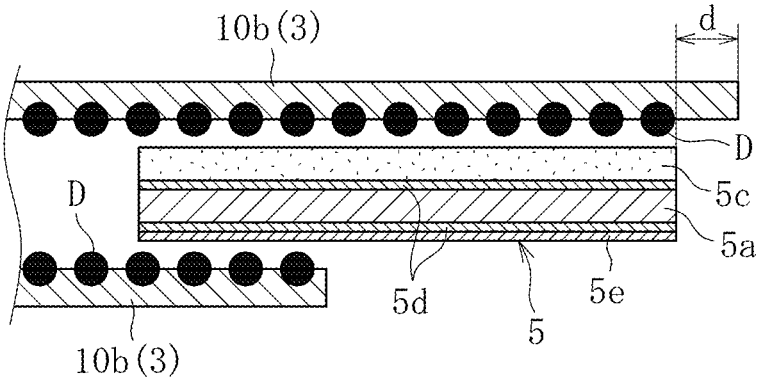
FIG. 4B is a cross-sectional view taken along the line III-III when the raised fabric is attached to a surface of FIG. 2Ba.

As illustrated in FIG. 4B, a raised fabric 5*e* may be further attached to the cover cloth 5*d* on the lower side in order to improve the feeling of touch. As illustrated in FIGS. 3B and 4B, a urethane elastomer film 5*c* is adhered to the surface of the hook tape 5 on a side where the hook tape 5 is attached to the front fabric 10*a*. In addition, the hook tape 5 is heat-pressed to be welded to the back surface of the front fabric 10*a* by the resin dots D and the urethane elastomer film 5*c*.

Since the hook tape 5 is overlapped on the end portion of the side belt 3 on the opposite side, the hook tape 5 does not come into direct contact with the skin. However, if the end portion of the hook tape 5 on a side of the cup portion 1 is exposed, such an exposure causes the hook tape 5 to tend to come off, and is not preferable in terms of appearance. Therefore, in the embodiment of the present invention, as illustrated in FIG. 2Ba, the end portion of the hook tape 5 on the side of the cup portion 1 is also covered with the back fabric 10*b* up to the vicinity of the hook fittings 5*b*.

Outer edges of the eye tape 4 and the hook tape 5 are set back (d) about 2 to 3 mm inward from outer edges of the front fabric 10*a*. If the outer edges of the tapes 4 and 5 are aligned with the outer edges of the front fabric 10*a* without the setback d, the outer edges of the tapes 4 and 5 tend to irritate the skin, resulting in a poor texture with a tingling feeling or the like.

As described above, in the fixing structure for fasteners according to the embodiment of the present invention, the back fabric 10*b* covering the tapes 4 and 5 is limited to one end portion sides of the tapes 4 and 5, and the outer edges of the tapes 4 and 5 exposed to the outside from the end portions of the back fabric 10*b* are set back inward with a predetermined length from the outer edges of the front fabric 10*a* and the back fabric 10*b*. Therefore, the positions of the eye tape 4 and the hook tape 5 are easy to find by touch, and the wearer can easily perform the attachment and detachment operations with both hands on the back side.

Furthermore, since the outer edges of the tapes 4 and 5 are set back and the outer edges of the tapes do not easily touch the skin, a good texture without a tingling feeling can be obtained. Therefore, it is possible to provide a fastener fixing structure particularly suitable for a non-sewn type brassiere having a good fit.

Although the embodiment of the present invention has been described above, it goes without saying that the present invention is not limited to the above embodiment and can be modified in various ways. For example, the raised fabrics 4*e* and 5*e* in FIGS. 4A and 4B are overlapped on and attached to the cover cloths 4*d* and 5*d*, but the lower cover cloths 4*d* and 5*d* may be omitted and the raised fabrics 4*e* and 5*e* may be directly attached to the interlinings 4*a* and 5*a*, and the cover cloth 4*d* between the urethane elastomer film 4*c* and the interlining 4*a* in FIG. 4A and the cover cloth 5*d* between the urethane elastomer film 5*c* and the interlining 5*a* in FIG. 4B may be omitted. Furthermore, the cover cloths 4*d* and 5*d* may have different fabrics between both sides of the interlinings 4*a* and 5*a*. Moreover, in the above embodiment, the straps 6 are used as shoulder straps, but a no-strap type is also possible for a half-cup or two-thirds-cup brassiere.

REFERENCE SIGNS LIST

1: Cup portion
2: Connecting portion
3: Side belt
3*a*: Slit
4: Eye tape
4*a*: Interlining
4*b*: Eye fitting
4*c*: Urethane elastomer film
4*d*: Cover cloth
4*e*: Raised fabric
5: Hook tape
5*a*: Interlining
5*b*: Hook fitting
5*c*: Urethane elastomer film
5*d*: Cover cloth
5*e*: Raised fabric
6: Strap
7*a*: Moving ring
7*b*: Fixed ring
8: Strap tab
9: Pad pocket
9*a*: Flange portion
10: Brassiere
10*a*: Front fabric
10*b*: Back fabric
C: Pad insertion port

The invention claimed is:

1. A brassiere comprising a fixing structure, the fixing structure comprising:

first and second side belts including a front fabric and a back fabric;

a hook fitting on a first tape-shaped interlining; and an eye fitting on a second tape-shaped interlining, wherein the first tape-shape interlining is attached between the front fabric and the back fabric of the first side belt via adhesive layers, the second tape-shaped interlining is attached between the front fabric and the back fabric of the second side belt via adhesive layers, outer edges of the first and second tape-shaped interlinings are set back inward by a predetermined length from outer edges of the front fabric, and the back fabric covering the first and second tape-shaped interlinings only covers one end portion side of each of the first and second tape-shaped interlinings.

2. The brassier according to claim 1, further comprising a raised fabric attached to an exposed surface of each of the first and second tape-shaped interlinings, the exposed surfaces being exposed to an outside from end portions of the back fabric.

3. The brassier according to claim 2, wherein a size of the setback is 2 to 3 mm.

4. The brassier according to claim 1, further comprising a cover cloth attached to one side or both sides of each of the first and second tape-shaped interlinings.

5. The brassier according to claim 4, wherein a size of the setback is 2 to 3 mm.

6. The brassier according to claim 1, further comprising a cover cloth and a raised fabric overlapped and attached to an exposed surface of each of the first and second tape-shaped interlinings, the exposed surfaces being exposed to an outside from end portions of the back fabric.

7. The brassier according to claim 6, wherein a size of the setback is 2 to 3 mm.

8. The brassier according to claim 1, wherein a size of the setback is 2 to 3 mm.

* * * * *